US009011270B2

(12) United States Patent
Nakano

(10) Patent No.: US 9,011,270 B2
(45) Date of Patent: Apr. 21, 2015

(54) IRON TYPE GOLF CLUB HEAD

(75) Inventor: Takashi Nakano, Kobe (JP)

(73) Assignee: SRI Sports Limited, Kobe (JP)

( * ) Notice: Subject to any disclaimer, the term of this patent is extended or adjusted under 35 U.S.C. 154(b) by 345 days.

(21) Appl. No.: 13/238,000

(22) Filed: Sep. 21, 2011

(65) Prior Publication Data

US 2012/0071270 A1 Mar. 22, 2012

(30) Foreign Application Priority Data

Sep. 22, 2010 (JP) ..... 2010-212499

(51) Int. Cl.

*A63B 53/00* (2006.01)
*A63B 53/04* (2006.01)
*A63B 53/08* (2006.01)

(52) U.S. Cl.

CPC ..... *A63B 53/047* (2013.01); *A63B 53/08* (2013.01); *A63B 2053/0408* (2013.01); *A63B 2053/0416* (2013.01); *A63B 2053/042* (2013.01); *A63B 2053/0491* (2013.01); *A63B 2209/00* (2013.01); *A63B 2053/0433* (2013.01)

(58) Field of Classification Search

USPC ..... 473/332, 349–350, 312
See application file for complete search history.

(56) References Cited

U.S. PATENT DOCUMENTS 3,995,865 A * 12/1976 Cochran et al. ..... 473/337
4,220,336 A * 9/1980 Kochevar ..... 473/312
4,826,172 A * 5/1989 Antonious ..... 473/350
4,938,470 A * 7/1990 Antonious ..... 473/242
5,261,669 A * 11/1993 Kochevar ..... 473/312
5,374,062 A * 12/1994 Kochevar ..... 473/312
5,492,327 A * 2/1996 Biafore, Jr. ..... 473/332
5,616,088 A * 4/1997 Aizawa et al. ..... 473/341
5,833,551 A * 11/1998 Vincent et al. ..... 473/350
6,080,069 A * 6/2000 Long ..... 473/332
6,884,179 B2 * 4/2005 Hoffman et al. ..... 473/312
7,621,822 B2 * 11/2009 Roach ..... 473/329
7,938,738 B2 * 5/2011 Roach ..... 473/329
7,976,403 B2 * 7/2011 Gilbert et al. ..... 473/309
8,088,022 B2 * 1/2012 Soracco et al. ..... 473/332
8,342,985 B2 * 1/2013 Hirano ..... 473/350

(Continued)

FOREIGN PATENT DOCUMENTS

JP 2005-74192 A 3/2005
JP 2007-229225 A 9/2007

OTHER PUBLICATIONS

Momentive, RTV627 Technical Data Shet, Feb. 14, 2014, Momentive, 1-4.*

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

An iron type golf club head includes a head main body, a toe-side weight member made of a metal material having specific gravity ρ2 larger than that of the head main body and disposed on a toe-side of the head main body, and a heel-side weight member made of a metal material having specific gravity ρ3 larger than that of the head main body and disposed on a heel-side of the head main body. The head main body includes a face main portion having a face to hit a golf ball, and a tubular hosel portion provided continuously on a heel-side of the face main portion and having a shaft inserting hole. A distance from the center of gravity Gt of the toe-side weight member to the center of gravity Gh of the heel-side weight member ranges from 50 to 120 mm.

19 Claims, 8 Drawing Sheets

(56) References Cited

U.S. PATENT DOCUMENTS

| | | | | |
|---|---|---|---|---|
| 2002/0034984 | A1* | 3/2002 | Takeda | 473/305 |
| 2002/0107087 | A1* | 8/2002 | Fagot | 473/291 |
| 2004/0204263 | A1* | 10/2004 | Fagot et al. | 473/291 |
| 2005/0130766 | A1* | 6/2005 | Nakahara | 473/349 |
| 2006/0100033 | A1* | 5/2006 | Nelson et al. | 473/349 |
| 2006/0172822 | A1* | 8/2006 | Liang et al. | 473/350 |
| 2006/0183568 | A1* | 8/2006 | Bamber | 473/349 |
| 2008/0051220 | A1* | 2/2008 | Soracco et al. | 473/350 |
| 2008/0058117 | A1* | 3/2008 | Roach | 473/332 |
| 2009/0075750 | A1* | 3/2009 | Gilbert et al. | 473/332 |
| 2009/0221382 | A1* | 9/2009 | Soracco et al. | 473/291 |
| 2009/0239681 | A1* | 9/2009 | Sugimoto | 473/350 |
| 2009/0291772 | A1* | 11/2009 | Boyd et al. | 473/291 |
| 2010/0056293 | A1* | 3/2010 | Cole et al. | 473/310 |
| 2010/0056294 | A1* | 3/2010 | Cole | 473/312 |
| 2010/0069172 | A1* | 3/2010 | Roach | 473/332 |
| 2010/0130306 | A1* | 5/2010 | Schweigert | 473/350 |
| 2010/0279796 | A1* | 11/2010 | Nicolette et al. | 473/350 |
| 2011/0201449 | A1* | 8/2011 | Roach | 473/332 |
| 2011/0230279 | A1* | 9/2011 | Oldknow et al. | 473/350 |
| 2011/0269571 | A1* | 11/2011 | Gilbert et al. | 473/332 |
| 2012/0190478 | A1* | 7/2012 | Roach et al. | 473/332 |

* cited by examiner

IRON TYPE GOLF CLUB HEAD

BACKGROUND OF THE INVENTION

1. Field of the Invention

The present invention relates to an iron type golf club head which has improved directional stability of a hit ball by increasing the moment of inertia around the vertical axis which passes through the center of gravity of the head.

2. Description of the Background Art

Conventionally, in order to improve directional movement or a flight distance of a hit ball, various improvements have been made to an iron type golf club head. For example, a technology of using a light alloy c having low specific gravity, such as an aluminum alloy, proposes in a part of a hosel section b, as shown in FIGS. 7 (*a*) and (*b*). Since this technology reduces weight of an upper side of a head a, the center of gravity of the club head a can be lowered.

However, in the club head a as described above, as the mass on the heel side becomes small, the moment of inertia around the vertical axis passing through the center of gravity g1 of the head also becomes small. Such a club head a has had a problem that if a golfer hits a ball at a position which is off a sweet spot ss, an intersecting point of a normal oriented to a face d from the center of gravity g1 of the head with the face d, a hit ball is liable to veer.

SUMMARY OF THE INVENTION

The present invention has been devised in light of the above actual circumferences, and a principal object of the present invention is to provide an iron type golf club head which has improved directional stability of a hit ball, basically by providing in a head main body a toe-side weight member and a heel-side weight member which are made of a metal material having a greater specific gravity than that of the head main body, and yet regulating a distance between the center of gravity of the toe-side weight member and that of the heel-side weight member within a certain range, thereby increasing the moment of inertia around a vertical axis passing through the center of gravity of the head.

An iron type golf club head according to the present invention includes a head main body, a toe-side weight member which is made of a metal material having a specific gravity ρ2 of greater than that of the head main body and which is disposed on the toe side of the head main body, and a heel-side weight member which is made of a metal material having a specific gravity ρ3 of greater than that of the head main body and which is disposed on the heel side of the head main body. In addition, in the club head according to the present invention, a distance from the center of gravity of the toe-side weight member to that of the heel-side weight member is 50 to 120 mm. Therefore, in the iron type golf club head according to the present invention, the great mass is allocated to each of the toe side and the heel side with a certain distance kept therebetween. Such an iron type golf club head has the greater moment of inertia around the vertical axis passing through the center of gravity of the head, and improves directional stability of a hit ball.

In the invention as described in claim 4, a face portion has a recessed part provided on a rear side, and a peripheral thick portion which surrounds the recessed part and has a greater thickness than the recessed part. The peripheral thick portion has a top-side thick part extending on the top section side of the face portion. The top-side thick part has a groove extending to a toe-heel direction. In the groove is disposed a light-weight member having a specific gravity ρ4 of less than that of the face portion. Since such an iron type golf club head has the lower center of gravity as weight of its top section is reduced, not only it has the directional stability, but also a ball hit therewith is likely to fly high.

DESCRIPTION OF THE PREFERRED EMBODIMENTS

An embodiment of the present invention will be described hereinafter with standard to the drawings.

Figure 1:
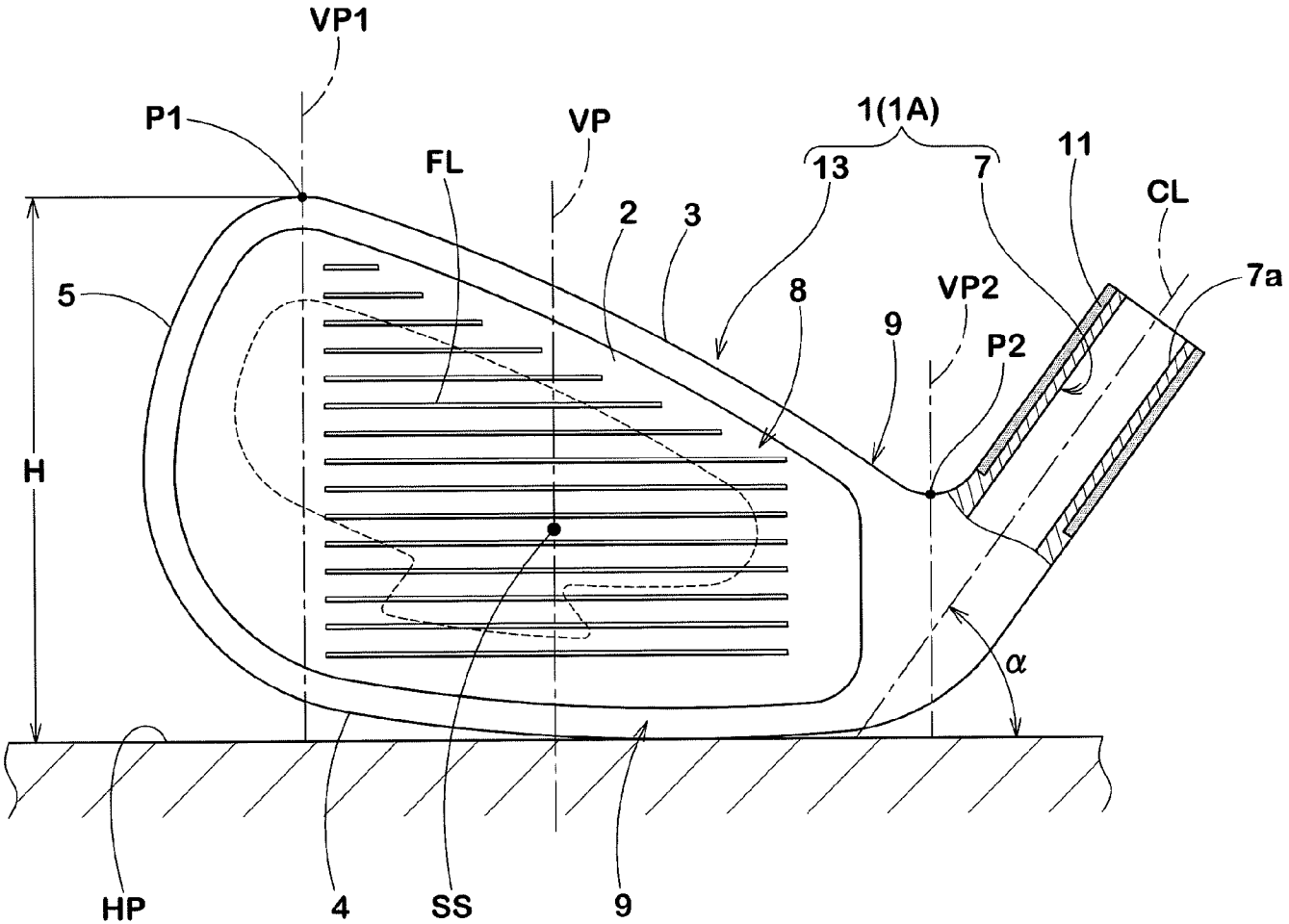
FIG. 1 is a front elevational view (including a partial cross-section) of a standard condition of an iron type golf club head according to one embodiment of the present invention.
Figure 2:
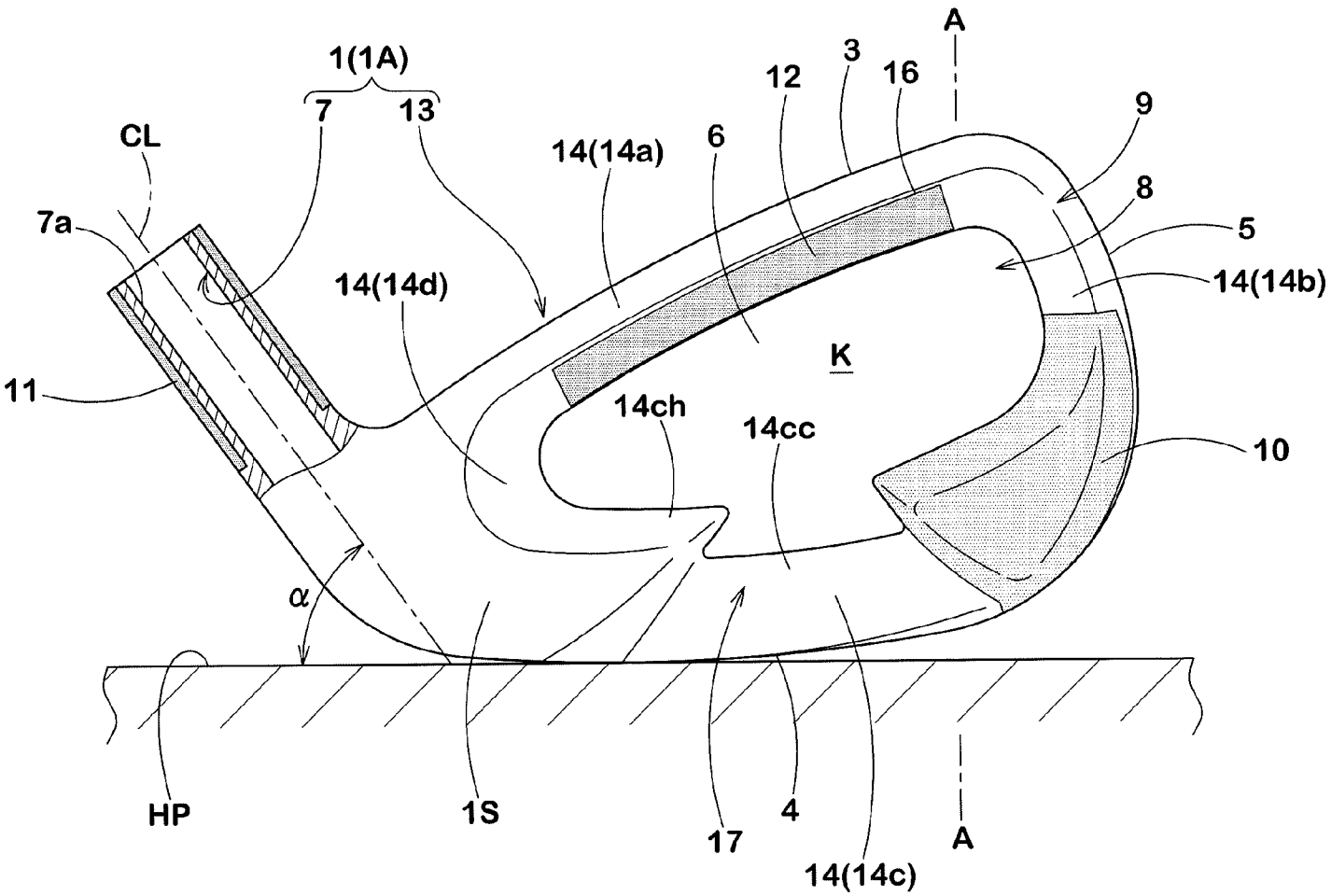
FIG. 2 is a rear elevational view (including the partial cross-section) thereof.
Figure 3:
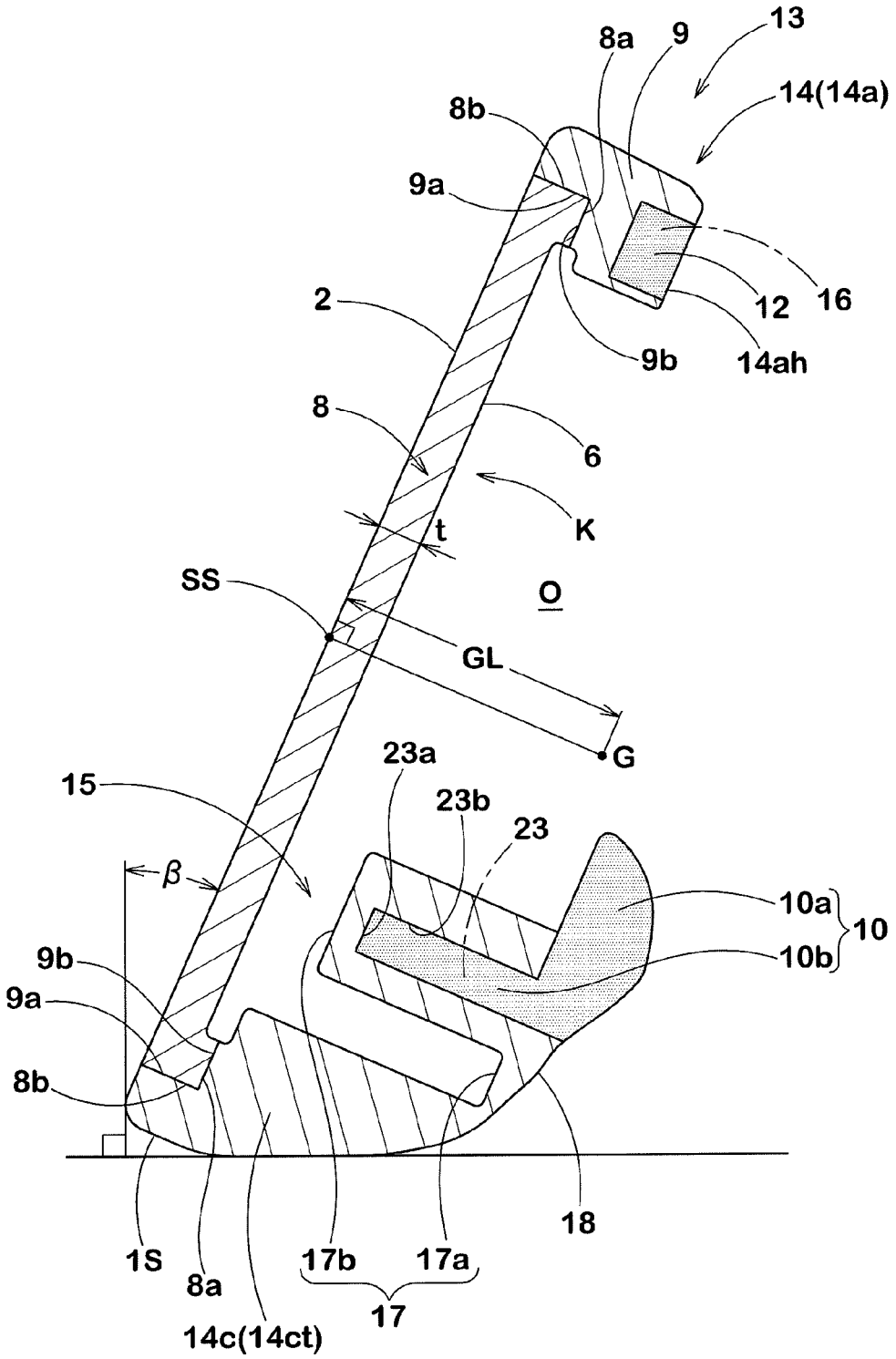
FIG. 3 is an enlarged end view of A-A of FIG. 2.

FIG. 1 to FIG. 3 show a standard condition of a golf club head 1 of this embodiment (which may be hereinafter simply referred to as a "head" or "club head"). Here, the standard condition of the club head 1 refers to a condition in which the head 1 is in contact with a horizontal plane HP, while the head 1 is being held at its lie angle α and loft angle β (as shown in FIG. 3). The club head 1 shall be placed in this standard condition, unless otherwise mentioned.

The club head 1 has a face 2 which hits a ball and is substantially planar, a top surface 3 which continues to an upper edge of the face 2 and forms a head top, a sole surface 4 which continues to a lower edge of this face 2 and forms a head bottom face, a toe surface 5 which smoothly curves between and connects the top surface 3 and the sole surface 4, a back face surface 6 which forms an opposite surface to the face 2, and a tubular portion 7 having a shaft inserting hole 7*a* into which a shaft (not shown) is mounted. In addition, when the club shaft is not mounted, the lie angle α of the head 1 can be based on a centerline CL of the shaft inserting hole 7*a*.

The face 2 includes a toe-side high point P1 located at the highest point on its upper edge side, and a heel-side low point P2 located at the lowest point on the upper edge side of the face 2. Both of these points P1 and P2 are on the face 2. A vertical plane which passes through the toe-side high point P1 and is at right angle to the face 2 is defined as a toe-side vertical plane VP1. A vertical plane which passes through the heel-side low point P2 and is at right angle to the face 2 is defined as a heel-side vertical plane VP2.

The top surface 3 is defined as a head upside part which extends between the toe-side vertical plane VP1 and the heel-side vertical plane VP2. Conventionally, the top surface 3 is inclined downward from the toe to the heel, extending almost linearly. The sole surface 4 is a head bottom face part which extends between the toe-side vertical plane VP1 and the heel-side vertical plane VP2, and most of it extends almost horizontal to the toe-heel direction. Furthermore, the toe surface 5 is defined as an end face part closer to the toe side than the toe-side vertical plane VP1, and, in this embodiment, arcuately curves and extends so as to be smoothly convex towards the outward.

It is desirable that the club head 1 of the embodiment is formed such that its overall weight is not less than 180 g, more preferably not less than 190 g, and even more preferably not less than 200 g. when the overall weight is less than 180 g, a swing balance may be aggravated because the head is too light. On the other hand, when the overall weight is too heavy, a golfer may not follow through and thus directional movement or flight distance of a hit ball may be aggravated. From such a standpoint, it is desirable that the overall weight of the club head 1 is preferably not greater than 340 g, more preferably not greater than 330 g, or even more preferably not greater than 320 g.

The club head 1 of the embodiment is configured to include a head main body 1A having the face 2 on its front surface, a toe-side weight member 10 disposed on the toe side of the head main body 1A, and a heel-side weight member 11 disposed on the heel side of the head main body 1A.

The head main body 1A of the embodiment is configured to include a face portion 13 having the face 2 on its front, and a tubular portion 7 connected to the heel side of the face portion 13.

Figure 5:
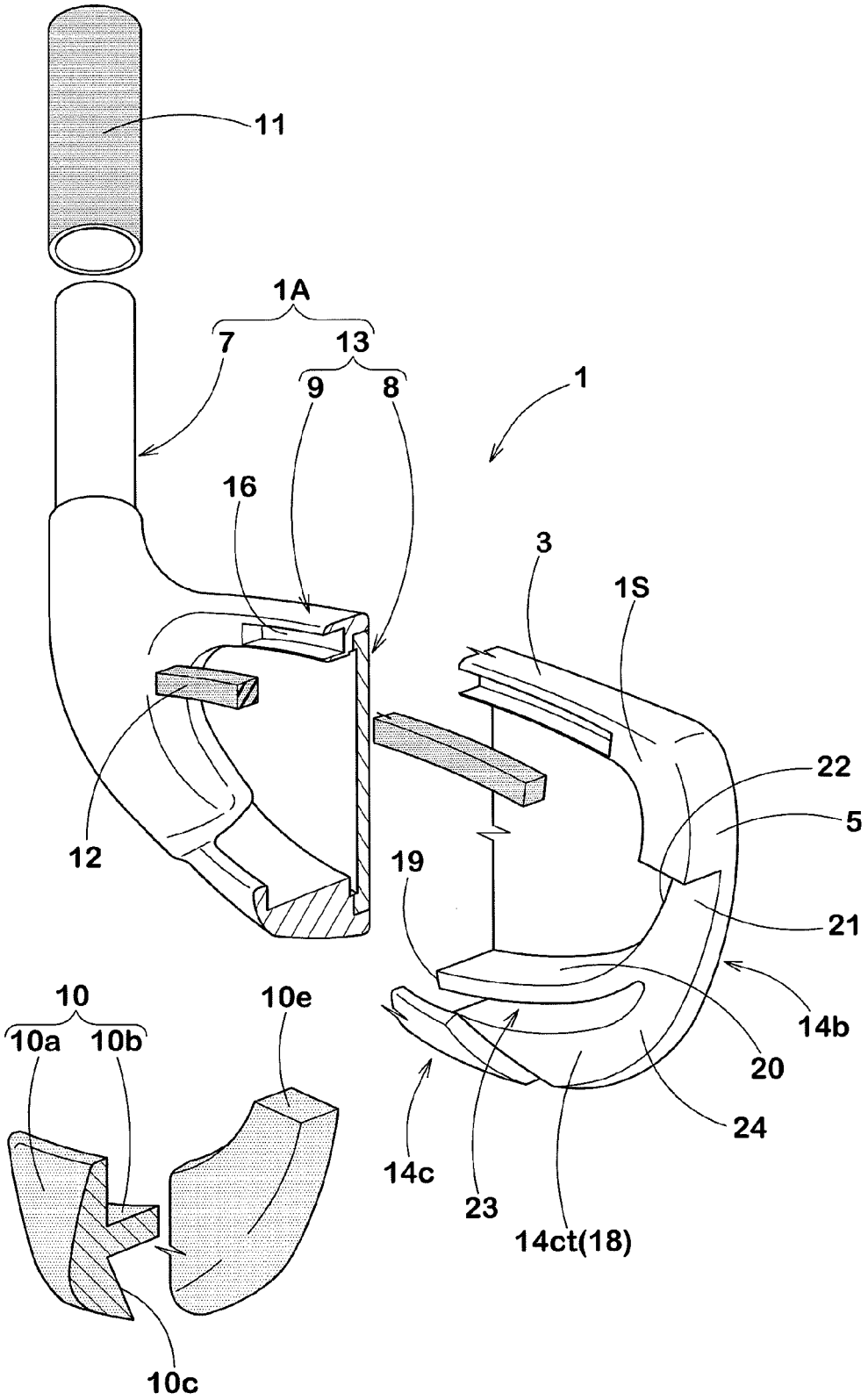
FIG. 5 is an exploded perspective view of the head of the embodiment.

As shown in FIG. 3 and FIG. 5, the face portion 13 is configured to include a plate-like face member 8 which is made of a metal material and includes at least a part of the face 2 (a main part, in this embodiment), and a face receiving section 9 which is made of a metal material and retains the face member 8 and with which the tubular portion 7 (as shown in FIG. 2) is integrally formed. It is desirable that the face member 8 is made of a metal material having high specific strength and excellent resilience. In addition, it is preferred that the face receiving section 9 is made of a metal material which is different from the face member 8 and has especially a higher specific gravity than the face member 8. Then, for the face member 8 and the face receiving section 9, various metal materials such as titanium, a titanium alloy, an aluminum alloy, stainless steel or soft iron, for example, may be adopted.

As in the embodiment, if the head main body 1A is formed of more than two kinds of materials, the specific gravity of the head main body 1A shall be an average specific gravity, and will be calculated at a ratio of volume of the face member 8 and that of the face receiving section 9. Then, it is desirable that the specific gravity ρ1 of the head main body 1A is preferably not lower than 4.0 and more preferably not lower than 4.5, or preferably not higher than 8.0 and more preferably not higher than 7.5.

A titanium alloy is adopted for the face member 8 of this embodiment. Stainless steel whose specific gravity is greater than the metal material of the face member 8 is used for the face receiving section 9. With this, more weight is allocated to the periphery of the face member 8, which thus provides the head 1 having the great moment of inertia or a large sweat area. It is needless to say that a combination of the metal materials for the face member 8 and the face receiving section 9 may be changed variously. For example, the face member 8 and the face receiving section 9 may be configured by a same metal material.

It is desirable that the face receiving section 9 and the tubular portion 7 are integrally formed as a casting. This improves productivity. The face member 8 and the face receiving section 9 are integrated by joining means such as welding, brazing, caulking, an adhesive and/or a screw.

Thickness t of the face member 8 is not specifically limited. However, there is a tendency that resilience of the head drops when the thickness t is too great, and strength is insufficient, thus aggravating durability when it is too small. Thus, it is desirable that the thickness t is preferably not less than 1.0 mm, more preferably not less than 1.2 mm, and even more preferably not less than 1.5 mm, or preferably not greater than 5.0 mm, more preferably not greater than 4.0 mm, and even more preferably not greater than 3.0 mm or less. on the face 2, a plurality of face lines FL such as a groove for increasing friction force with a ball are provided at intervals, as needed.

As shown in FIG. 3, the face member 8 of the embodiment includes a raised section 8*a* which protrudes in a small length behind the head in the periphery on its rear side and annularly extends. Since such a face member 8 not only improves rigidity of a joint with the face receiving section 9, but also can increase a contact area with the face receiving section 9, it is firmly joined with the face receiving section 9.

The face receiving section 9 is shaped like a frame surrounding an opening O which penetrates back and forth. The face receiving section 9 of the embodiment includes an inward face 9*a* which faces an outer periphery 8*b* of the face member 8 and which is fit with the outer periphery 8*b*, and a forward face 9*b* which extends to the inside of the head on the side of the back face surface 6 of the inward face 9*a* and which supports the raised section 8*a* across the circumference of the head 1. In addition, the face receiving section 9 is provided with a face mount whose cross-section is almost step-like.

As shown in FIG. 1, the inward face 9*a* has a profile shape which is substantially same in size as the outer periphery 8*b* of the face member 8 and continues annularly. The inward face 9*a* has depth dimension which is substantially same as thickness of the outer periphery 8*b* of the face member 8. A forward face 9*b* of the embodiment which continues annularly is shown. However, these configurations can also be changed as appropriate.

Not only the toe-side weight member 10 is made of a metal material having the specific gravity ρ2 of greater than that of the head main body 1A, but also the heel-side weight member 11 is configured by a metal material having the specific gravity ρ3 of greater than that of the head main body 1A. Separately arranging on the toe side and the heel side of the head main body 1A the toe-side and the heel-side weight members 10, 11, which are made of materials having such a high specific gravity, can increase the moment of inertia around the vertical axis passing through the center of gravity G of the head 1 (hereinafter, such moment of inertia may be referred to as "moment of inertia Ig"), thereby improving the directional stability of a hit ball.

Figure 4:
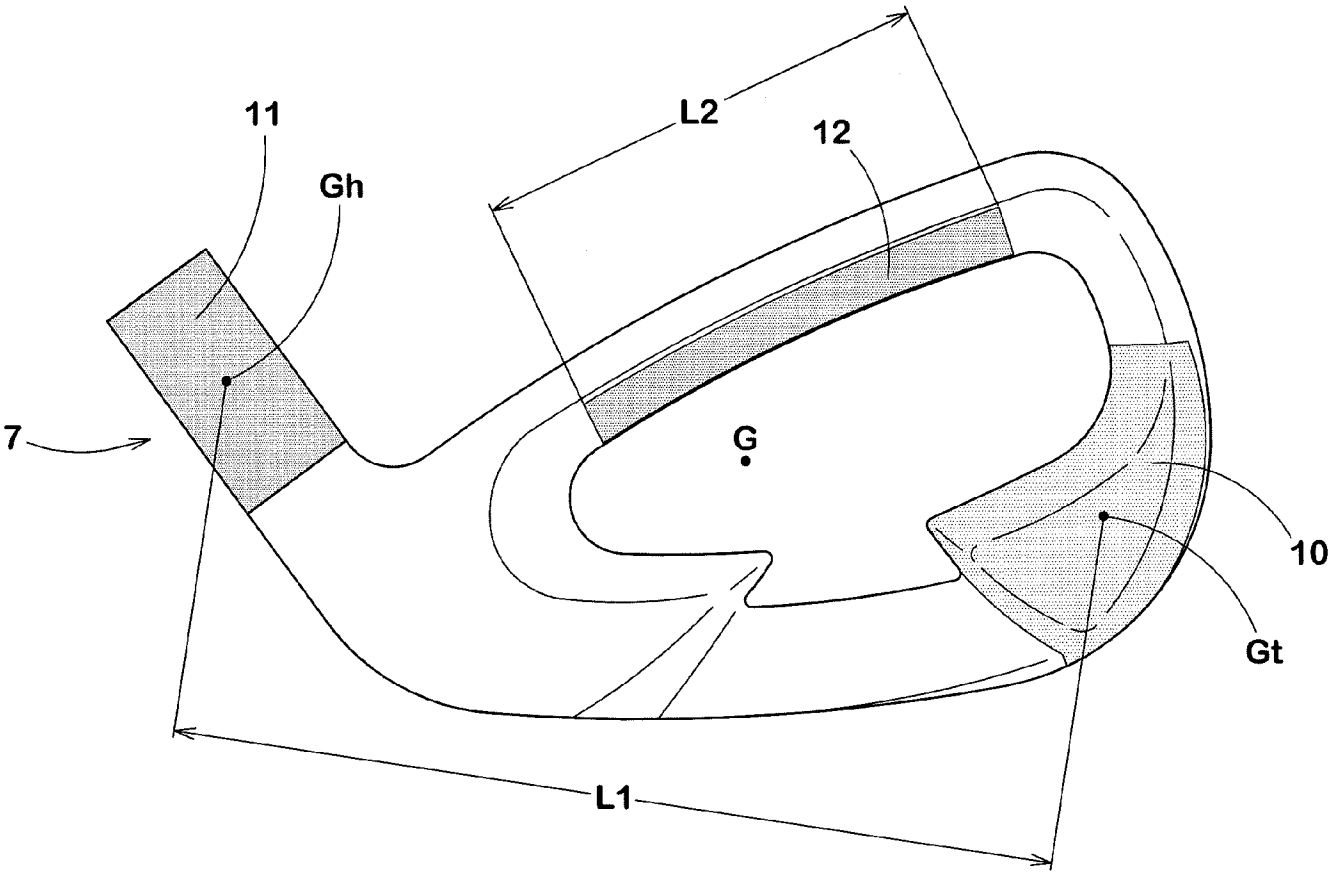
FIG. 4 is a rear elevational view of FIG. 1.

As shown in FIG. 4, a distance L1 from the center of gravity Gt of the toe-side weight member 10 to the center of gravity Gh of the heel-side weight member 11 is set to be 50 to 120 mm. When the distance L1 is less than 50 mm, the moment of inertia Ig is smaller, thereby aggravating the directional stability of a hit ball. On the contrary, when the distance L1 exceeds 120 mm, length of the head in the toe-heel direction increases, thus aggravating easiness to swing and reducing a flight distance of a hit ball. From such a standpoint, it is desirable that the distance L1 is preferably not less than 60 mm, more preferably not less than 70 mm or preferably not longer than 110 mm and more preferably not longer than 100 mm.

Such an iron type golf club head 1 can optimize length of the head in the toe-heel direction, while increasing the moment of inertia Ig. Therefore, the iron type golf club head 1 according to the present invention is excellent in the directional stability of a hit ball or easiness to swing a club. The club head 1 of the embodiment can have the moment of inertia Ig of preferably not less than 2350 $g \cdot cm^2$ and more preferably not less than 2400 $g \cdot cm^2$. On the other hand, since there is a tendency that if the moment of inertia Ig is excessively great, the mass of the club head increases, thus making swinging difficult, it is desirable that the moment of inertia Ig is preferably not greater than 3400 g·cm$^2$ and more preferably not greater than 3350 g·cm$^2$.

As shown in FIG. 2 and FIG. 3, the face portion 13 has on its rear side a recessed part K which hollows on the face side, and the face portion 13 has a peripheral thick portion 14 surrounding the recessed part K and protruding backwardly of the head 1 from the recessed part K. Then, in the embodiment, the toe-side weight member 10 is provided in the peripheral thick portion 14.

The peripheral thick portion 14 of the embodiment includes a top-side thick part 14*a* with a groove 16 extending in a toe-heel direction of the head 1, a toe-side thick part 14*b* which continues to the top-side thick part 14*a* and extends along the toe surface 5, a sole-side thick part 14*c* which continues to the toe-side thick part 14*b* and extends along the sole surface 4, and a heel-side thick part 14*d* which connects the top-side thick part 14*a* and the sole-side thick part 14*c* on the heel side. These parts continue and are formed so as to surround a sweet spot SS (as shown in FIG. 3). So-called a cavity back structure having such a peripheral thick portion 14 allocates more weight to the back of the head and the rear periphery of the face 2, thereby being helpful in increasing the moment of inertia Ig and improving the directional stability of a hit ball.

Furthermore, as shown in FIG. 2 and FIG. 3, in the sole-side thick part 14*c* of the embodiment is provided a back wall section 17 which stands up to the head top side behind the head 1. A gap 15 is formed between the back wall section 17 and the back face surface 6. The gap 15 provides a space in which the face member 8 can freely bend to the head rear face when a ball is hit, and is helpful in improving resilience of the club head.

As shown in FIG. 2, when the head in a standard condition is viewed from the rear, the back wall section 17 has a toe-side part 14*ct* (as shown in FIG. 3) which extends on the toe side, a heel-side part 14*ch* which extends on the heel side, and an intermediate part 14*cc* which is not only connected via a step difference therebetween but also is slightly higher than the toe-side part 14*ct* and the heel-side part 14*ch*.

In addition, as shown in FIG. 3, the back wall section 17 provided on the toe-side part 14*ct* of the embodiment is formed to include a first wall section 17*a* which has small thickness and stands upward at the back end of the sole-side thick part 14*c*, and a second wall section 17*b* which stands upward while protruding forward from the first wall section 17*a*. Therefore, in FIG. 3, the gap 15 is formed such that its cross-section is shaped like the letter L. Such a configuration controls an excessive increase in the mass of the head 1 and improves the easiness to swing. In the back wall section 17 of the embodiment, the second wall section 17*b*, which is close to the back face surface 6, is disposed above the first wall section 17*a*. Such an aspect controls a reduction in a flight distance since the face member 8 is less likely to come in contact with the back wall section 17 even if the face member 8 bends due to hitting.

Also, as shown in FIG. 5, the toe-side part 14*ct* is configured to include a toe rear 18 which is a backward face of the head, a toe lateral face 19 which continues to the heel side of the toe rear 18 and extends to the back face surface 6 side, and a top rear 20 which continues to the head top side on the toe rear 18 and extends to the back face surface 6 side. The toe rear 18 is smoothly connected as a same plane to a toe back 21 which is a backward face of the head of the toe-side thick part 14*b*. In this way, the toe rear 18 and the toe back 21 are formed by a fixing face 24 which is a single face. Therefore, the fixing face 24 can be securely fixed to a face 10*c* on the back face surface 6 side of the toe-side weight member 10. The top rear 20 is smoothly connected as a same plane to a toe inward face 22 which is a face on the heel side of the toe-side thick part 14*b*.

In addition, in the toe-side part 14*ct* is provided with a notch section 23 which is horizontally cut long into the toe rear 18 from the toe lateral face 19 to the toe back 21. Such a notch section 23 more securely fixes the toe-side weight member 10.

As shown in FIG. 3, the notch section 23 includes a bottom face 23*a* which is located on the back face surface 6 side rather than on the toe rear 18, and a lateral face 23*b* which extends from the bottom face 23*a* to the toe rear 18. In this embodiment, the bottom face 23*a* and the lateral face 23*b* are configured as an almost U-letter when viewed at the end face. The lateral face 23*b* of the embodiment extends orthogonally in effect, from the edge of the bottom face 23*a* to the toe rear 18. However, the lateral face 23*b* shall not be limited to such an aspect, and may extend to the toe rear 18 like a taper. This can more firmly fix the toe-side weight member 10 to the notch section 23.

As shown in FIG. 2, the toe-side weight member 10 of the embodiment extends from a toe-side thick part 14*b* to a sole-side thick part 14*c* of the peripheral thick portion 14. Since such a toe-side weight member 10 can allocate weight to the toe side of the head 1 and the lower side, it can dispose the center of gravity G of the head 1 more on the toe side and the lower side. Thus, the moment of inertia Ig of the head 1 of the embodiment increases. The toe-side weight member 10 comprises a surface part 10*a* which forms an external surface of the golf club head 1, and a convex part 10*b* which is provided on the face 2 side of the surface area 10*a* and inserted into the notch section 23. As shown in FIG. 5, the upper edge 10*e* of the toe-side weight member 10 is smoothly connected to an external surface is of the head main body 1A without having any step. Additionally, caulking or the like, for example, can be adopted as a method for fixing the notch section 23 and the toe-side weight member 10. Welding, for example, can be adopted as a method for fixing the toe-side thick part 14*b* and the toe-side weight member 10.

In addition, the heel-side weight member 11 of the embodiment is formed as a cylinder to fit outside or inside (outside in the embodiment) inserted into the tubular portion 7. That is to say, as shown in FIG. 4, the heel-side weight member 11 is formed on the head 1 at the closest position to the heel side in the toe-heel direction. Thus, since a distance Lh from the center of gravity G of the head 1 to the center of gravity Gh of the heel-side weight member 11 can be made larger, the moment of inertia Ig can be increased. It can also be expected that the heel-side weight member 11 achieves the operation and effect similar to the above, even in a form in which the heel-side weight member 11 fitted inside the tubular portion 7.

A shape of the heel-side weight member 11 is not specifically limited. Thus, it may take various forms such as in a rectangular tubular shape, a triangular tubular shape or the like. Above all, the tubular shape as in the embodiment is desirable in terms of the production efficiency. The heel-side weight member 11 is also formed flush with the external surface is of the head main body 1A, without having a step.

Since the toe side of the club head 1 becomes heavy if the specific gravity ρ2 of the to-side weight member 10 is too great, the club is difficult to swing. on the contrary, if the specific gravity ρ2 is too small, the moment of inertia around the vertical axis passing through the center of gravity G of the head becomes small, which thus tends to aggravate the directional stability of a hit ball. From such a standpoint, it is desirable that the specific gravity ρ2 is preferably not less than 8 and more preferably not less than 10, or preferably not more than 12 and more preferably not more than 11.

From a similar standpoint, it is desirable that the specific gravity ρ3 of the heel-side weight member 11 is preferably not less than 4 and more preferably not less than 8, or preferably not more than 20 and more preferably not more than 19.

In order to further improve the operation and effect, it is desirable that the ratio of ρ3/ρ2 of the specific gravity ρ2 of the toe-side weight member 10 and the specific gravity ρ3 of the heel-side weight member 11 is preferably not less than 0.3 and more preferably not less than 0.8, or preferably not more than 2.5 and more preferably not more than 2.1.

The mass of the toe-side weight member 10 and the heel-side weight member 11 can be defined in different ways. However, in order to improve the directional stability of a hit ball and easiness to swing in a well-balanced manner, it is desirable that the mass of the toe-side weight member 10 is preferably not less than 25 g and more preferably not less than 30 g, or preferably 60 g or less and more preferably 55 g or less. Similarly, it is desirable that the mass of the heel-side weight member 11 is preferably 5 g or more and more preferably 10 g or more, or preferably not more than 25 g and more preferably not more than 20 g.

Although the toe-side weight member 10 and the heel-sideweight member 11 are not specifically limited, one kind or two or more kinds of metal material(s) such as stainless, tungsten, a tungsten alloy, a copper alloy, a nickel alloy or the like is(are) preferred. In the embodiment, a tungsten alloy containing tungsten, stainless steel and nickel is adopted for the toe-side weight member 10, and a tungsten alloy containing tungsten and nickel is adopted for the heel-side weight member 11.

In addition, as shown in FIG. 2 and FIG. 3, the top-side thick part 14*a* has the groove 16 which opens on a top rear 14*ah*, which is a backward side face of the head 1 of the top-side thick part 14*a*, and extends in the toe-heel direction. Although the groove 16 is rectangular shaped in the embodiment, it may have the cross section which is almost semicircular or triangular shaped. The form may be such that the groove 16 opens on the top surface 3, or the top surface 3 and the top rear 14*ah* open (not shown). The latter form is desirable because it can make the head 1 have a lower center of gravity.

In the groove 16 is disposed a lightweight member 12 having the specific gravity ρ4 of less than that of the face portion 13. Such a lightweight member 12 is useful in making it easy to hit a ball high as it reduces weight of the upper side of the head 1, thereby lowering the center of gravity of the head 1. Thus, the golf club in which such a lightweight member 12 is disposed has a greater flight distance. Various methods such as an adhesive or caulking are adopted as a method for fixing the lightweight member 12 and the groove 16.

In order to effectively achieve lowering of the center of gravity of the head 1, it is desirable that the specific gravity ρ4 of the lightweight member 12 is preferably not more than 2.5 and more preferably not more than 2.0. From a similar standpoint, it is desirable that the mass of the lightweight member 12 is preferably not more than 2.0 g and more preferably not more than 1.5 g.

In order to improve moldability while lowering the center of gravity of the head 1, for example, a resin, in particular, a thermoplastic resin such as a polypropylene resin or a polystyrene resin is preferably used as a material constituting the lightweight member 12. These resin materials are helpful in absorbing any vibration that is generated on the top section side when a ball is hit.

If length L2 of the lightweight member 12 in the toe-heel direction is too great, rigidity of the top-side thick part 14*a* becomes small, which may thus cause damage due to hitting or the like. On the contrary, if the length L2 is too small, it may not be expected that lowering of the center of gravity of the head 1 can be well achieved. From such a standpoint, it is desirable that the length L2 is preferably not shorter than 20 mm and more preferably not shorter than 30 mm, or preferably not longer than 90 mm and more preferably not longer than 80 mm.

Comparison Test

In order to ensure the effect of the present invention, iron type golf club heads having a basic configuration as shown in FIG. 1 to FIG. 4 and based on the specification in Table 1 were prototyped and various kinds of tests were conducted on them. Each of the heads was molded by fixing, with an adhesive and through caulking, a face receiving section attached to a tubular portion formed of a casting which was made by molding SUS630 with the lost-wax precision casting method, and a face member which is a pressed mold of Ti-6Al-4V. All parameters except those shown in Table 1 are identical.

Listed below are common specifications.

Head overall weight: unified to 250 g (5-iron).
Lie angle: 61°
Loft angle: 24°
Specific gravity ρ1 of the head main body: 7.8
Greatest height H of the head main body: 55 mm
Thickness t of the face member: 2.2 mm
Toe-side weight member: A tungsten-nickel alloy
Heel-side weight member: A titanium-tungsten-nickel alloy
Binding of the toe-side weight member and the face portion: welding
Binding of the heel-side weight member and the tubular portion: Adhesion
Binding of the face receiving section and the lightweight member: Adhesion
Volume of the toe-side weight member: 4.5 $cm^3$
Volume of the heel-side weight member: 1.0 $cm^3$
Lightweight member: Polystyrene resin
Cross section area of the lightweight member (average): 14 $mm^2$
Specific gravity of the lightweight member: 1.8

A testing method is as described below.

<Easiness to Swing, Directional Movement, Easiness to Fly High, and Average Flight Distance>

First, 38-inch iron clubs were prototyped by mounting an identical FRP shaft (MP-300, Flex R, manufactured by SRI sports Limited) to each sample head. Then, actual hitting tests were conducted by five 5- to 15-handicap golfers using each test club and commercially available Three-piece Golf Ball (XXIO (trademark of SRI sports Limited)) manufactured by the same company. Each golfer hits five balls with each test club. The easiness to swing, directional movement, easiness to fly high, and average flight distance were evaluated in 5 ranks, and an average value thereof was calculated. The larger a numeric value is, the better the head is.

In addition, the "moment of inertia" in Table 1 is the moment of inertia around the vertical axis passing through the center of gravity G of the head in the standard condition. Additionally, "height of sweet spot" in Table 1 is height from a horizontal plane HP to a sweet spot ss in the standard condition as shown in FIG. 3. Furthermore, as shown in FIG.

3, "depth of center of gravity GL" in Table 1 is length of a normal which runs from the center of gravity of the head down to the face surface.

Table 1 shows test results, and the like.

TABLE 1

Figure 6A:
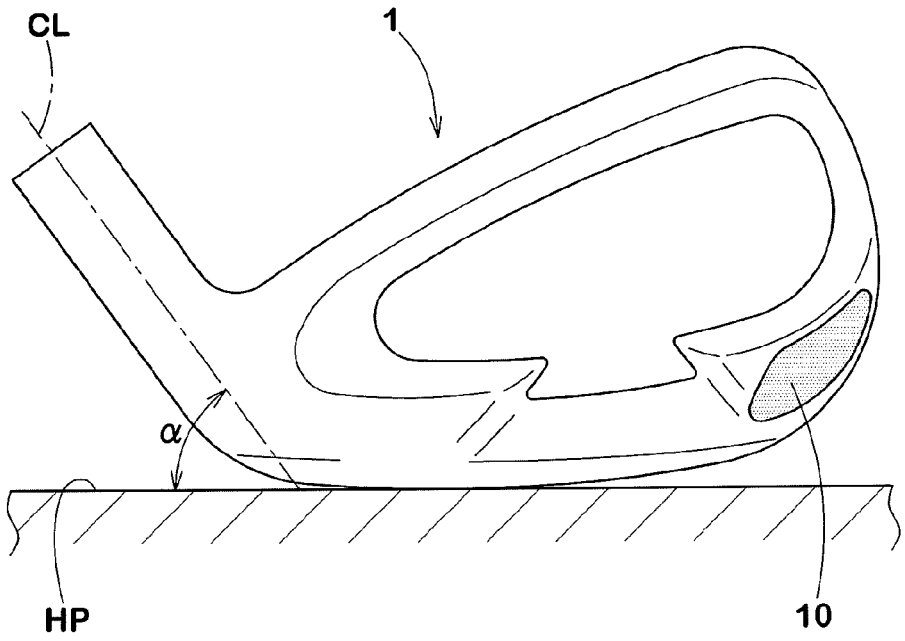
FIG. 6 (*a*) is a view showing a structure of Comparative Example 1, and FIG. 6 (*b*) is a view showing that of Comparative Example 2 and of Embodiments 1 to 3.
Figure 6B:
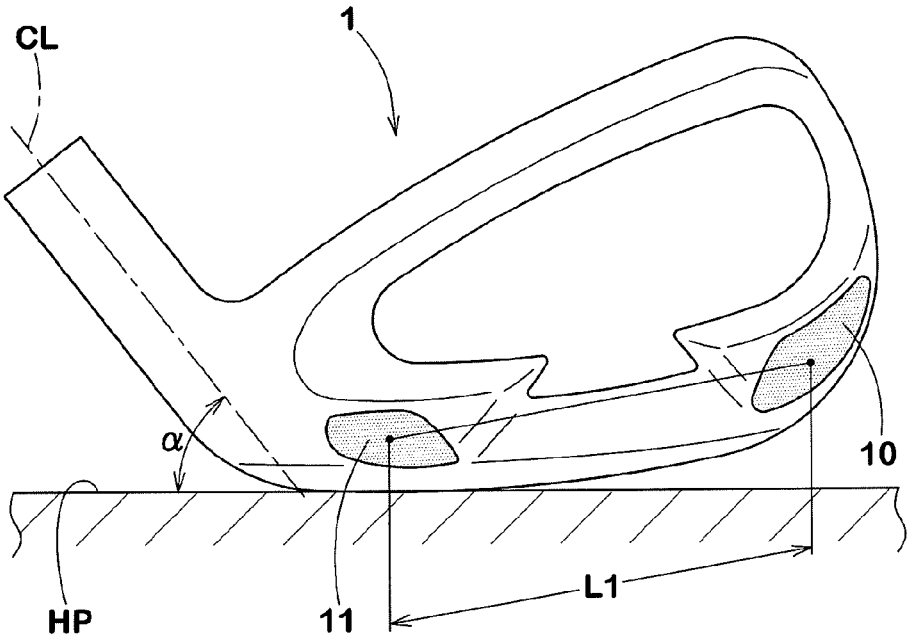
Figure 7A:
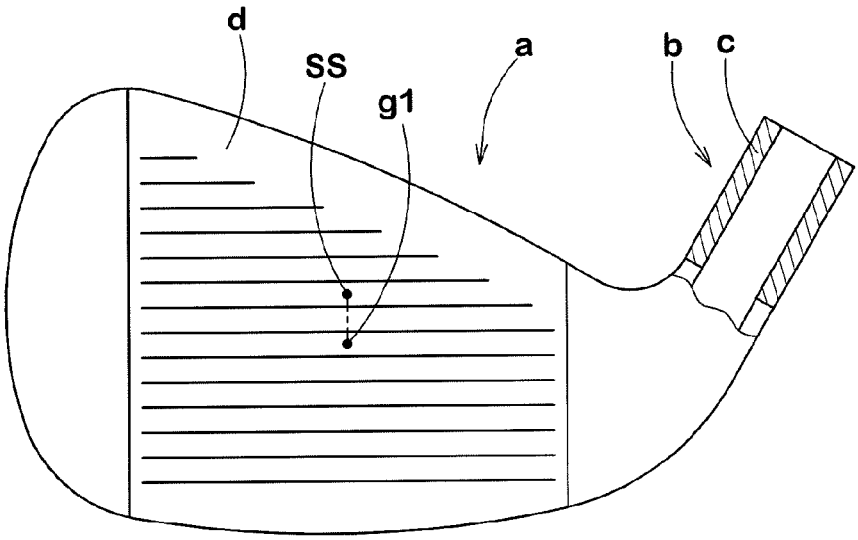
FIG. 7 (*a*) and FIG. 7 (*b*) are a front elevational view and a sectional view of a head, illustrating the prior art technology.
Figure 7B:
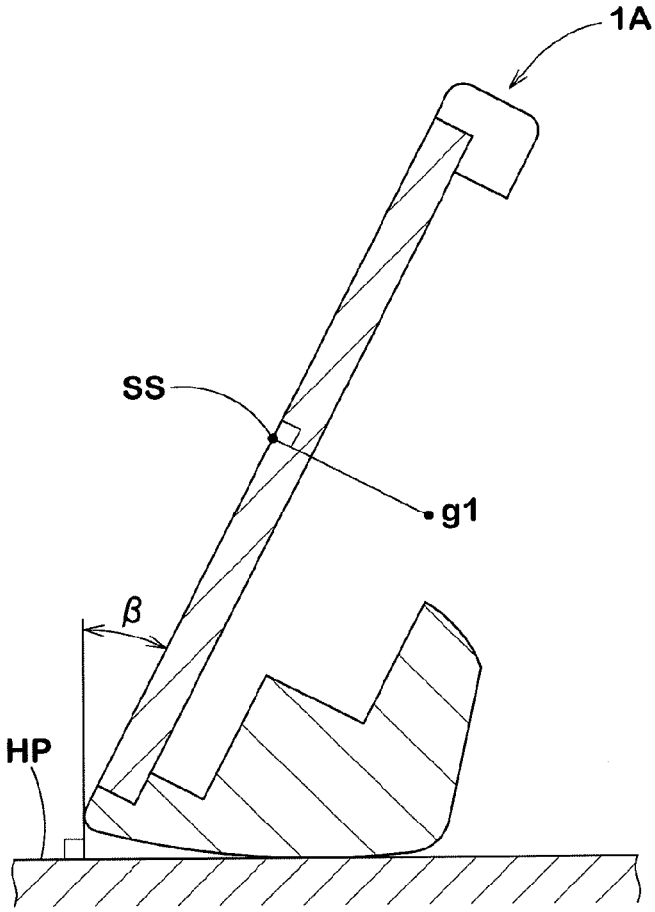
Figure 8:
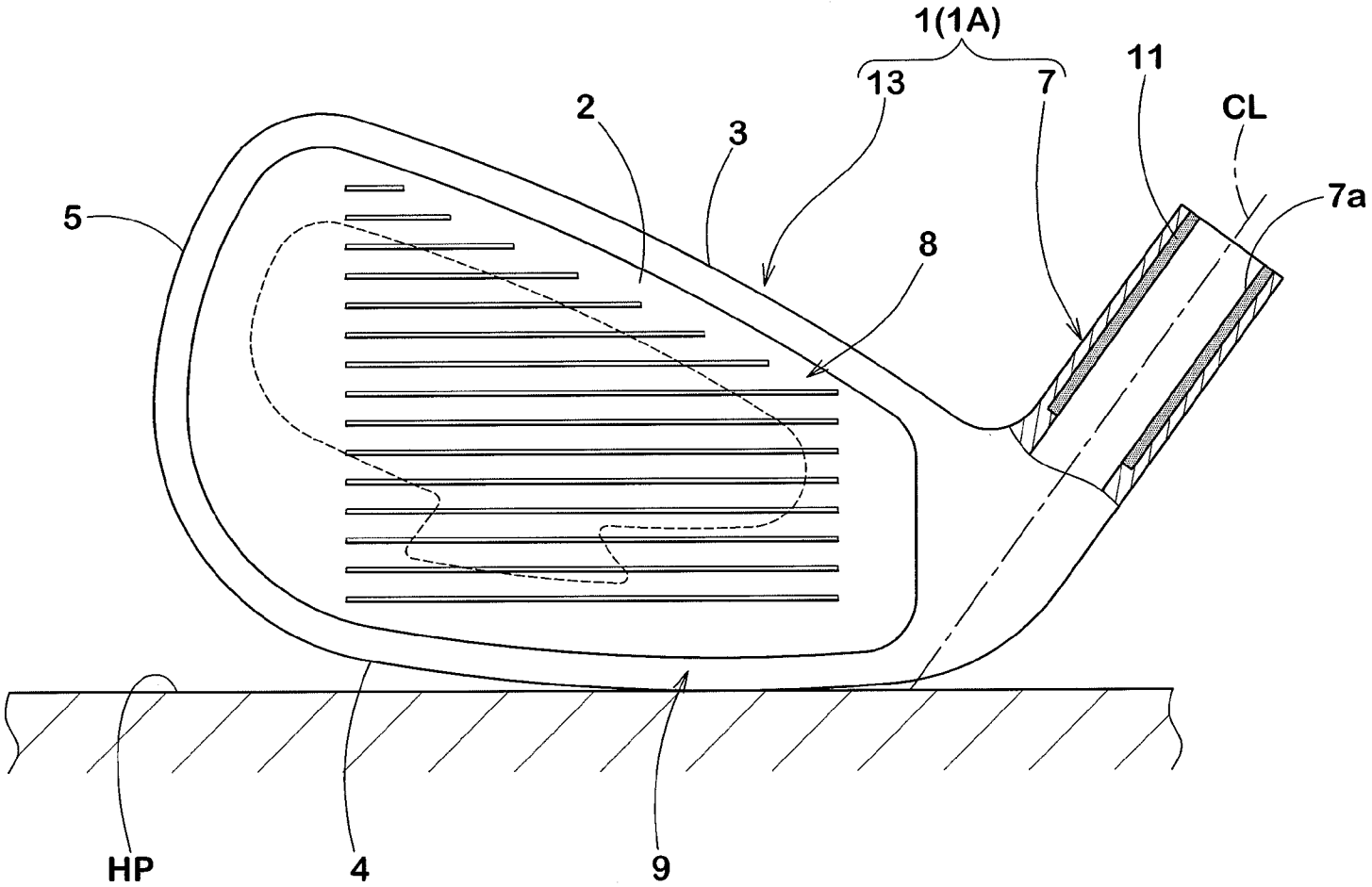
FIG. 8 shows a heel side weight member fitted inside the tubular portion.

| | Comparative Example 1 | Comparative Example 2 | Example 1 | Example 2 | Example 3 | Example 4 | Example 5 | Comparative Example 3 | Example 6 |
|---|---|---|---|---|---|---|---|---|---|
| Figure showing a structure of a club head | FIG. 6 (a) | FIG. 6 (b) | FIG. 6 (b) | FIG. 6 (b) | FIG. 6 (b) | FIG. 2 | FIG. 2 | FIG. 2 | FIG. 2 |
| Distance L1 from the center of gravity of the toe-side weight member to that of the heel-side weight member (mm) | 40 | 40 | 50 | 65 | 95 | 95 | 120 | 130 | 85 |
| Specific gravity of the toe-side weight member ρ2 | 7 | 7 | 8 | 8 | 8 | 8 | 8 | 8 | 8 |
| Specific gravity of the heel-side weight member ρ3 | — | 3 | 8 | 8 | 8 | 8 | 8 | 8 | 8 |
| Length of the lightweight member L2 (mm) | 0 | 0 | 0 | 0 | 0 | 0 | 0 | 0 | 0 |
| Moment of inertia Ig ($g \cdot cm^2$) | 2100 | 2300 | 2360 | 2440 | 2600 | 2700 | 3000 | 3500 | 2700 |
| Height of sweat spot (mm) | 23.0 | 21.7 | 21.7 | 21.7 | 21.7 | 22.5 | 22.5 | 22.5 | 21.7 |
| Depth of center of gravity GL (mm) | 4.5 | 4.9 | 4.9 | 4.9 | 4.9 | 5.2 | 5.2 | 5.2 | 5.1 |
| Easiness to swing "The greater a numeric value is, the better it is." | 2 | 3 | 4 | 4 | 4 | 4 | 4 | 2 | 4 |
| Directional movement "The greater a numeric value is, the better it is." | 1 | 2 | 3 | 3 | 4 | 4 | 4 | 3 | 4 |
| Easiness to fly high "The greater a numeric value is, the better it is." | 2 | 3 | 4 | 4 | 4 | 4 | 4 | 4 | 4 |
| Average flight distance "The greater a numeric value is, the better it is." | 2 | 2 | 3 | 3 | 3 | 4 | 4 | 2 | 4 |

| | Example 7 | Example 8 | Example 9 | Example 10 | Example 11 | Example 12 | Example 13 | Example 14 | Example 15 |
|---|---|---|---|---|---|---|---|---|---|
| Figure showing a structure of a club head | FIG. 2 | FIG. 2 | FIG. 2 | FIG. 2 | FIG. 2 | FIG. 2 | FIG. 2 | FIG. 2 | FIG. 2 |
| Distance L1 from the center of gravity of the toe-side weight member to that of the heel-side weight member (mm) | 85 | 85 | 85 | 85 | 85 | 85 | 85 | 85 | 85 |
| Specific gravity of the toe-side weight member ρ2 | 12 | 12 | 12 | 12 | 10 | 10 | 10 | 10 | 10 |
| Specific gravity of the heel-side anchor member ρ3 | 8 | 16 | 20 | 22 | 12 | 12 | 12 | 12 | 12 |
| Length of the lightweight member L2 (mm) | 0 | 0 | 0 | 0 | 0 | 80 | 30 | 20 | 60 |
| Moment of inertia Ig ($g \cdot cm^2$) | 2900 | 3200 | 3300 | 3400 | 3000 | 3000 | 3100 | 3100 | 3000 |
| Height of sweat spot (mm) | 21.2 | 21.8 | 22.1 | 22.4 | 21.5 | 20.0 | 20.5 | 20.6 | 20.0 |
| Depth of center of gravity GL (mm) | 4.9 | 4.7 | 4.5 | 4.4 | 4.8 | 4.8 | 4.8 | 4.8 | 4.8 |
| Easiness to swing "The greater a numeric value is, the better it is." | 4 | 4 | 4 | 4 | 5 | 5 | 5 | 5 | 5 |
| Directional movement "The greater a numeric value is, the better it is." | 4 | 5 | 5 | 5 | 5 | 5 | 5 | 5 | 5 |
| Easiness to fly high "The greater a numeric value is, the better it is." | 4 | 4 | 3 | 3 | 4.8 | 5 | 5 | 5 | 5 |
| Average flight distance "The greater a numeric value is, the better it is." | 4 | 5 | 4 | 4 | 5 | 5 | 5 | 5 | 5 |

As a result of the tests, it can be confirmed that in the iron type golf club head of Examples, the directional movement and the easiness for a ball to fly high have been significantly improved, compared with Comparative Examples.

What is claimed is:

1. An iron type golf club head comprising:

a head main body including a face portion having in its front surface a club face for hitting a ball and having a back face, wherein the face portion is provided with a sole-side thick part having a back wall section standing upward so as to form a gap between the back wall section and the back face; the back wall section including a first wall section and a second wall section, the first wall section standing upward at the back end of the sole-side thick part, the second wall section standing upward from the first wall section while protruding forward with respect to the first wall section, and the second wall having a back with a notch section formed thereon;

a tubular portion having a shaft inserting hole and connected to the face portion on the heel side thereof;

a toe-side weight member made of a metal material having a specific gravity ρ2 greater than that of the head main body, and disposed on a toe side portion of the head main body, wherein the toe-side weight member is fixed to the notch section;

a heel-side weight member made of a metal material having a specific gravity ρ3 of greater than that of the head main body, and disposed on a heel side portion of the head main body, and the toe-side weight member center of gravity being disposed at a distance from the heel-side weight member center of gravity in a range of from 50 to 120 mm.

2. The iron type golf club head according to claim 1, wherein the heel-side weight member is formed in a cylindrical shape and fitted inside the tubular portion.

3. The iron type golf club head according to claim 2, wherein the face portion is provided on the rear side thereof with a recessed part so that the face portion has a peripheral thick portion surrounding the recessed part and protruding backwardly of the head from the recessed part, the peripheral thick portion is provided in its top-side thick part with a groove extending in a toe-heel direction of the head, and a lightweight member having a specific gravity ρ4 of less than that of the face portion is disposed in the groove.

4. The iron type golf club head according to claim 2, wherein the face portion is provided on the rear side thereof with a recessed part so that the face portion has a peripheral thick portion surrounding the recessed part and protruding backwardly of the head from the recessed part, and said toe-side weight member extends from a toe-side thick part to the sole-side thick part of the peripheral thick portion.

5. The iron type golf club head according to claim 1, wherein the heel-side weight member is formed in a cylindrical shape and fitted outside the tubular portion.

6. The iron type golf club head according to claim 5, wherein the face portion is provided on the rear side thereof with a recessed part so that the face portion has a peripheral thick portion surrounding the recessed part and protruding backwardly of the head from the recessed part, the peripheral thick portion is provided in its top-side thick part with a groove extending in a toe-heel direction of the head, and a lightweight member having a specific gravity ρ4 of less than that of the face portion is disposed in the groove.

7. The iron type golf club head according to claim 5, wherein the face portion is provided on the rear side thereof with a recessed part so that the face portion has a peripheral thick portion surrounding the recessed part and protruding backwardly of the head from the recessed part, and said toe-side weight member extends from a toe-side thick part to the sole-side thick part of the peripheral thick portion.

8. The iron type golf club head according to claim 1, wherein the face portion is provided on the rear side thereof with a recessed part so that the face portion has a peripheral thick portion surrounding the recessed part and protruding backwardly of the head from the recessed part, the peripheral thick portion is provided in its top-side thick part with a groove extending in a toe-heel direction of the head, and a lightweight member having a specific gravity ρ4 of less than that of the face portion is disposed in the groove.

9. The iron type golf club head according to claim 8, wherein the specific gravity ρ4 of the lightweight member is not higher than 2.5.

10. The iron type golf club head according to claim 1, wherein the face portion is provided on the rear side thereof with a recessed part so that the face portion has a peripheral thick portion surrounding the recessed part and protruding backwardly of the head from the recessed part, and said toe-side weight member extends from a toe-side thick part to the sole-side thick part of the peripheral thick portion.

11. The iron type golf club head according to claim 10, wherein the back wall section comprises a toe-side part, a heel-side part, and an intermediate part connected therebetween and having a height lower than those of the toe-side part and the heel-side part.

12. The iron type golf club head according to claim 11, wherein the heel-side part has a first protruding section extending upward toward the toe side, the toe-side part has a second protruding section extending upward toward the heel side, a protruding end of the first protruding section is located on the toe side rather than an heel end of a upper edge of the intermediate part, and a protruding end of the second protruding section is located on the heel side rather than a toe end of the upper edge of the intermediate part.

13. The iron type golf club head according to claim 10, wherein the peripheral thick portion includes a toe-side part having a rear surface provided with the notch section, and the toe-side weight member comprises a convex part being inserted into the notch section and a front face fixed to the rear surface of the toe-side part.

14. The iron type golf club head according to claim 1, wherein the face portion is provided on the rear side thereof with a recessed part so that the face portion has a peripheral thick portion surrounding the recessed part and protruding backward of the head from the recessed part, and the peripheral thick portion is provided in its sole-side thick part extending along a sole surface forming a head bottom surface.

15. The iron type golf club head according to claim 14, wherein the sole-side thick part comprises a toe rear facing backward of the head, the notch section is recessed from the toe rear toward the club face, and the toe-side weight member comprises a front face attached to the toe rear, and a convex part protruding from the front face and inserted into the notch section.

16. The iron type golf club head according to claim 15, wherein the toe rear is recessed from an external surface of the head.

17. The iron type golf club head according to claim 1, wherein the toe-side weight member protrudes backward of the head from an external surface of the head main body.

18. The iron type golf club head according to claim 1, wherein the specific gravity ρ3 of the heel-side weight member is greater than the specific gravity ρ2 of the toe-side weight member, and a volume of the heel-side weight member is less than a volume of the toe-side weight member.

19. The iron type golf club head according to claim 1, wherein the notch section has a bottom face which is located on the back face surface side rather than on a toe rear and a lateral face extending from the bottom face to a toe rear, and the rear-front direction length of the lateral face is larger than the up-down direction length of the bottom face.

* * * * *